US008392001B1

(12) United States Patent
Isik et al.

(10) Patent No.: US 8,392,001 B1
(45) Date of Patent: Mar. 5, 2013

(54) METHOD AND APPARATUS FOR EXTERNALLY AIDED SELF ADJUSTING REAL TIME CLOCK

(75) Inventors: Tacettin Isik, Saratoga, CA (US); Jan Gazda, Sammamish, WA (US)

(73) Assignee: Integrated Device Technology, Inc., San Jose, CA (US)

( * ) Notice: Subject to any disclaimer, the term of this patent is extended or adjusted under 35 U.S.C. 154(b) by 462 days.

(21) Appl. No.: 12/114,754

(22) Filed: May 3, 2008

(51) Int. Cl.
*G04G 5/00* (2006.01)

(52) U.S. Cl. ..... 700/42; 368/200; 368/201

(58) Field of Classification Search ..... 368/200, 368/201, 202
See application file for complete search history.

(56) References Cited

U.S. PATENT DOCUMENTS 4,068,463 A * 1/1978 Maeda et al. ..... 368/187
4,300,224 A * 11/1981 Nakazaki et al. ..... 368/201
4,321,698 A * 3/1982 Gomi et al. ..... 368/202
4,441,826 A * 4/1984 Morokawa et al. ..... 368/204
4,600,316 A * 7/1986 Besson ..... 368/187
4,879,700 A * 11/1989 MacIntyre ..... 368/117
4,899,117 A * 2/1990 Vig ..... 331/3
4,903,251 A * 2/1990 Chapman ..... 368/156
4,914,831 A * 4/1990 Kanezashi et al. ..... 33/780
5,274,545 A * 12/1993 Allan et al. ..... 368/156
5,363,348 A * 11/1994 Damle ..... 368/47
5,640,373 A * 6/1997 Davis ..... 368/156
6,146,011 A * 11/2000 Owai ..... 368/202
6,744,699 B2 * 6/2004 Klein et al. ..... 368/204
7,184,847 B2 * 2/2007 Sun et al. ..... 700/42
2003/0076747 A1 4/2003 Jung

* cited by examiner

*Primary Examiner* — R S Luebke
*Assistant Examiner* — Jason Collins
(74) *Attorney, Agent, or Firm* — Heimlich Law, PC; Alan Heimlich, Esq.

(57) ABSTRACT

A method and apparatus for externally aided self adjusting real time clock have been disclosed. A circuit having a pulse train output is coupled to an adjusting circuit, a real-time clock is coupled to the adjusting circuit, and a proportional integral derivative time processor is coupled to the adjusting circuit, and where the adjusting circuit affects the pulse train output.

5 Claims, 10 Drawing Sheets

METHOD AND APPARATUS FOR EXTERNALLY AIDED SELF ADJUSTING REAL TIME CLOCK

FIELD OF THE INVENTION

The present invention pertains to clocks. More particularly, the present invention relates to a method and apparatus for externally aided self adjusting real time clock (RTC) (also denoted real-time clock).

BACKGROUND OF THE INVENTION

Autonomous clocks may drift with time. This drift may not be noticed if clocks are tied and/or synchronized to atomic clocks via, for example, some communication channel. When disconnected for a while, we may notice that our independent clock will diverge from the correct real time. One such example is the clock in our computers. If we disconnect them from a network for a few days, the clock will continue ticking but it will drift seconds away from other computers' clocks that are synchronized to atomic clocks. This drift may present a problem, such as, incorrect creation dates of files, etc.

BRIEF DESCRIPTION OF THE DRAWINGS

The invention is illustrated by way of example and not limitation in the figures of the accompanying drawings in which.

SUMMARY OF THE INVENTION

Figure 1:
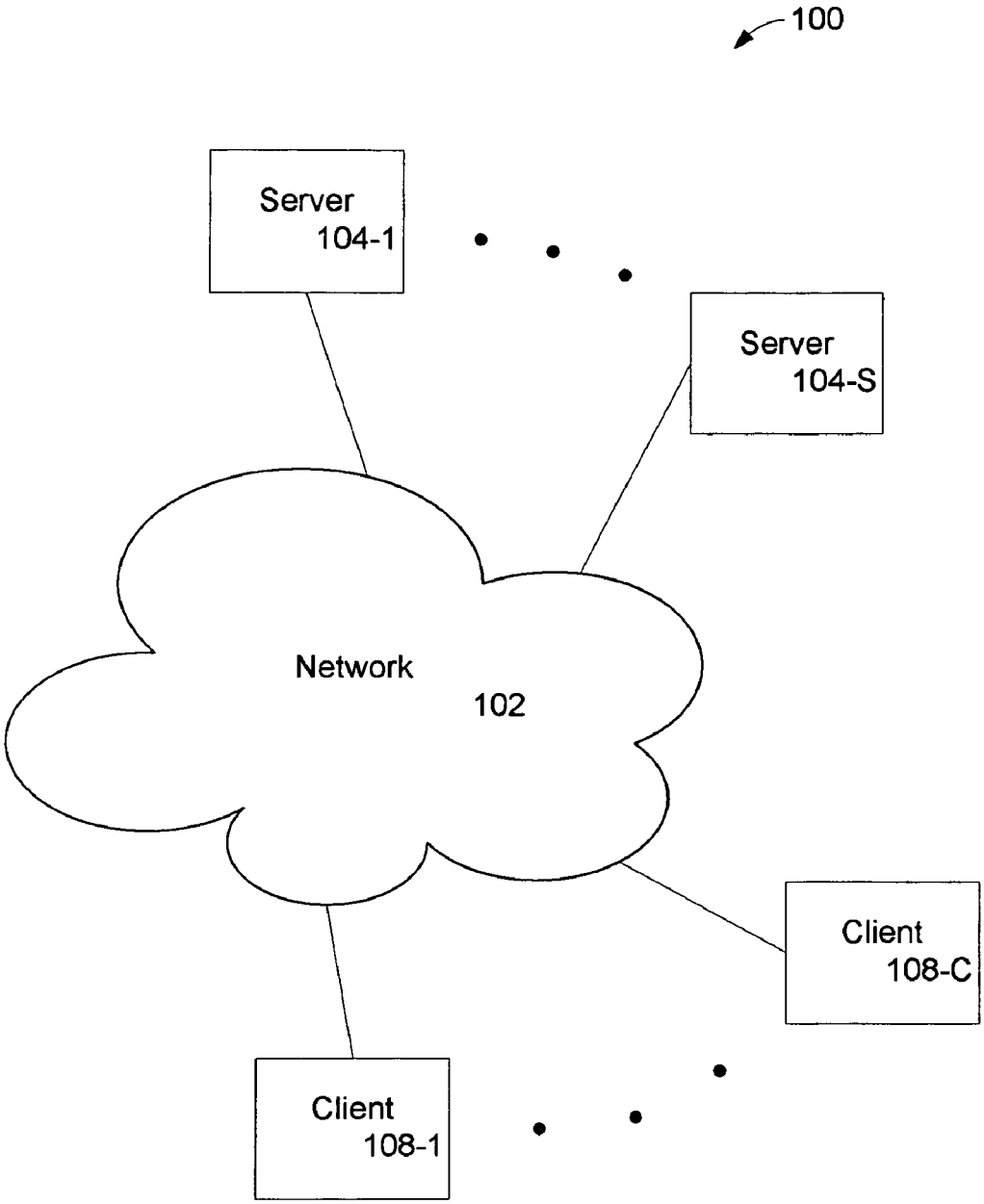
FIG. 1 illustrates a network environment in which the method and apparatus of the invention may be implemented.

Applicant(s) hereby submit that this Summary of the Invention complies with applicable CN (China i.e. SIPO) standards. All claims are literally copied here.

1. A method comprising:
   (a) using a previously generated time correction factor to adjust a clock;
   (b) determining if a known accurate time is available; and
   (b1) if not then:
      (b1a) continuing to use said previously generated time correction for said clock;
   (b2) if so then:
      (b2a) generating a new time correction factor to adjust said clock;
      (b2b) denoting said new time correction factor a previously generated time correction factor; and
      (b2c) continuing at (a).

2. The method of claim 1 wherein said determining if a known accurate time is available may be determined at a random interval.

3. The method of claim 1 further comprising not adjusting an oscillator circuit for said clock prior to said clock deployment.

4. A method comprising:
   receiving a correct time at an arbitrary time;
   getting a relative time from a clock
   calculating an adjustment based on said received correct time at said arbitrary time and said relative time from said clock; and
   applying said adjustment at a non-periodic time to said clock.

5. The method of claim 4 wherein applying said adjustment at said non-periodic time to said clock comprises controlling an input to said clock.

6. An apparatus comprising:
   an oscillator having a pulse output;
   a controlling block having an input, a control input, and an output, wherein said input is operatively coupled to said oscillator pulse output;
   a time counter block having an input and one or more outputs, said input operatively coupled to said controlling block output, said one or more outputs producing a tangible usable output for a user; and
   a signal operatively coupled to said controlling block control input.

7. The apparatus of claim 6 wherein said signal has a first state and a second state, wherein said first state subtracts one or more pulses from said oscillator pulse output, and wherein said second state adds one or more pulses to said oscillator pulse output.

8. An apparatus comprising:
   means for generating a series of pulses;
   means for coupling said series of pulses to a control circuit input;
   means for coupling a control circuit output to a time counter circuit producing a usable tangible result for a user.

9. The apparatus of claim 8 further comprising:
   means for directing said control circuit to allow said series of pulses to pass substantially unaltered from said control circuit input to said control circuit output.

10. The apparatus of claim 8 further comprising:
   means for directing said control circuit to remove one or more pulses from said series of pulses, denoted as remittitur series of pulses, and passing said remittitur series of pulses to said control circuit output.

11. The apparatus of claim 8 further comprising:
   means for directing said control circuit to add one or more pulses to said series of pulses, denoted as additur series of pulses, and passing said additur series of pulses to said control circuit output.

12. An apparatus comprising:
   a circuit having a pulse train output;
   an adjusting circuit having an input, a control input, and an output, said input coupled to said;
   a real-time clock having an input and one or more outputs, said input coupled to said adjusting circuit output, and said one or more outputs producing a usable tangible result for a user.

13. The apparatus of claim 12 wherein said adjusting circuit control input can leave said pulse train unaltered.

14. The apparatus of claim 13 wherein said adjusting circuit control input can remove one or more pulses from said pulse train.

15. The apparatus of claim 14 wherein said adjusting circuit control input can add one or more pulses to said pulse train.

16. The apparatus of claim 15 wherein said pulse train output is a 32768 Hz pulse train output.

DETAILED DESCRIPTION

In one embodiment of the invention, a time correction factor need not be done at regular intervals. For example, in one embodiment of the invention a time correction factor may take place any time connection to another source of time is established. Thus the time interval between time correction factors may be entirely random.

In one embodiment of the invention, a real time clock-calendar circuit may be driven by a resonator that adjusts its frequency by self learning based on externally set values. These adjustments increase the accuracy of the clock for the times when no external set operations are available. When the system in which the clock circuit is working, is powered down, the circuit will memorize the speed it adjusted itself to, therefore the clock will be keeping the time more accurately even when external aid does not exist.

In one embodiment of the invention, the adjustment based on self learning may allow a less accurate resonator to be used where a more accurate resonator without self learning might be needed. This may reduce costs for the time keeping function. For example an RC based oscillator may be used in place of a crystal oscillator.

In one embodiment of the invention, the self learning capability may assist in compensating for such things as temperature variations in addition to drift that may be attributed to other factors, such as crystal aging.

In one embodiment of the invention, the self learning capability may eliminate the need to initially adjust an oscillator circuit. That is, the oscillator circuit need not be adjusted prior to deployment (e.g. use) in a circuit. This may assist in reducing the component count, time needed for calibration, and/or costs.

In one embodiment of the current invention a set value of a real time clock (RTC) does not go directly into the counter that counts the clock signal's pulses, rather a value goes into a set register. The current value of the time and the set value are compared in a logic block and an error amount is generated. This error is written into a circuit that erases or adds one or more pulses within a calculated duration from the clock signal. This operation will be continuously done until a new set value is entered. Every set entry affects the next calculation in a proportional-integral-derivative control fashion. When there have been a sufficient number of set entries done, accuracy of the clock may approach the clock of the entity which is doing the set entries. Since the error amount and correction may be kept in memory, the correction may be kept even if no more set values are entered.

For sake of illustration we will discuss a RTC based on a 32,768 Hz crystal, however the invention is not so limited and may be used at any frequency and with any other type of circuit as well.

Figure 3:
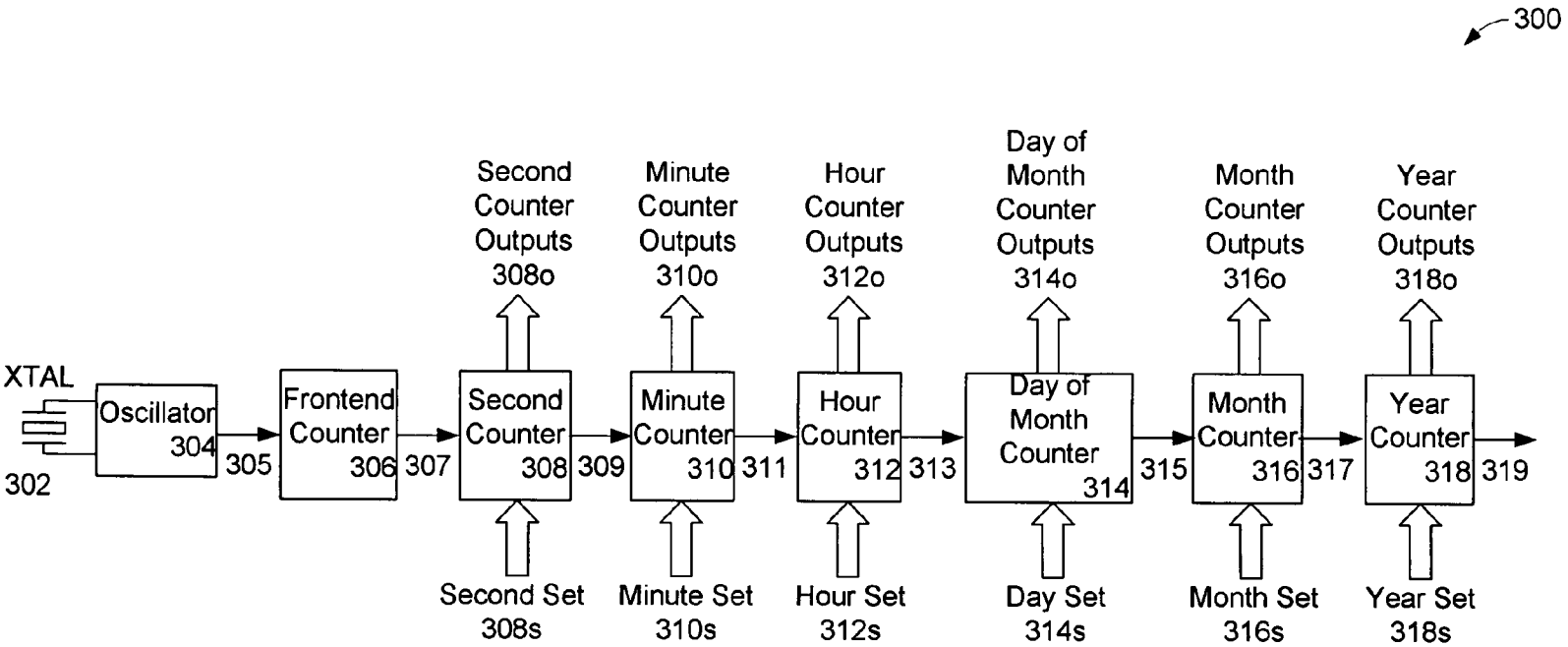
FIG. 3 illustrates a real time clock in block diagram form.

FIG. 3 illustrates, generally at 300, a real time clock in block diagram form. At 302 is a crystal, at 304 an Oscillator. The output of the Oscillator 304 may be, for example a 32768 Hz signal. The output 305 of the Oscillator 304 goes to a Frontend Counter 306. The Frontend Counter 306 may be, for example, a 32768 to 1 divider (2^15). The output 307 of the Frontend Counter 306 may be, for example, a 1 Hz or 1 pulse per second output. The output 307 goes to Second Counter 308 that has an output 309 that goes to Minute Counter 310 that has an output 311 that goes to Hour Counter 312 that has an output 313 that goes to Day of Month Counter 314 that has an output 315 that goes to Month Counter 316 that has an output 317 that goes to Year Counter 318 that may have an output denoted here as 319. Each of the counters (Second Counter 308, Minute Counter 310, Hour Counter 312, Day of Month Counter 314, Month Counter 316, Year Counter 318) have a respective set input (Second Set 308*s*, Minute Set 310*s*, Hour Set 312*s*, Day Set 314*s*, Month Set 316*s*, and Year Set 318*s*) and a respective group of outputs (Second Counter Outputs 308*o*, Minute Counter Outputs 310*o*, Hour Counter Outputs 312*o*, Day of Month Counter Outputs 314*o*, Month Counter Outputs 316*o*, and Year Counter Outputs 3180).

In one embodiment of the invention, set inputs such as those shown in FIG. 3 at Second Set 308*s*, Minute Set 310*s*, Hour Set 312*s*, Day Set 314*s*, Month Set 316*s*, and Year Set 318*s* may be used to adjust or set one or more of the respective counters (Second Counter 308, Minute Counter 310, Hour Counter 312, Day of Month Counter 314, Month Counter 316, Year Counter 318).

Figure 4:
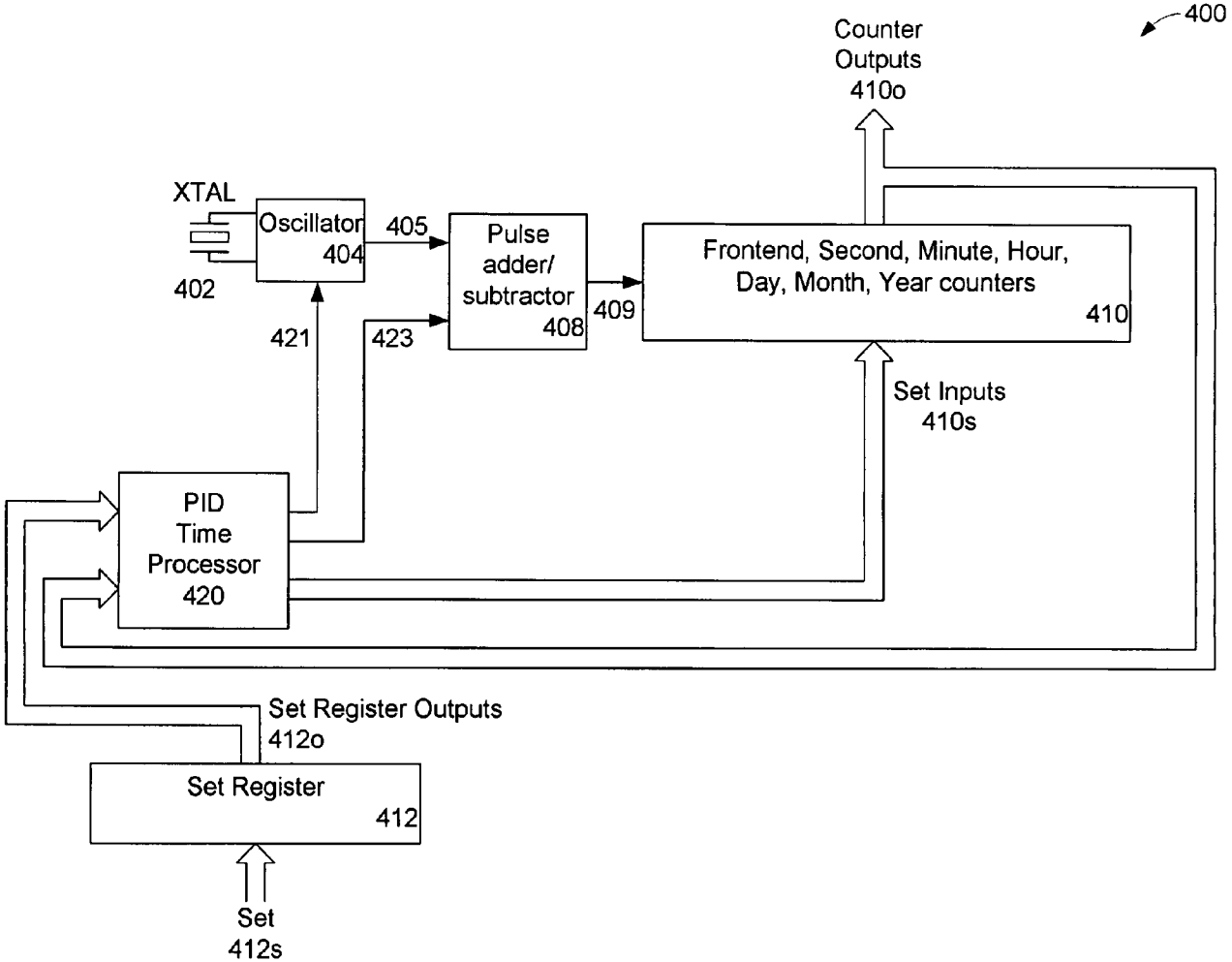
FIG. 4 illustrates one embodiment of the invention in block diagram form.

FIG. 4 illustrates, generally at 400, one embodiment of the invention in block diagram form. In this implementation of an embodiment, the counters 410 may run similar to that shown in FIG. 3 at 306, 308, 310, 312, 314, 316, and 318 with the respective sets and outputs represented by, for example, 410 for the counters, 410*s* for the Set Inputs, and 410*o* for Counter Outputs. In this embodiment there is a Pulse adder/subtractor 408 added in front of the counters 410. Counter Outputs 410*o* produce a tangible usable output for a user, such as a time display.

At 402 is a crystal, at 404 an Oscillator whose output 405 goes to the Pulse adder/subtractor 408. Going into Oscillator 404 is a possible input 421 from the PID Time Processor 420. Going into the Pulse adder/subtractor 408 is output 423 from the PID Time Processor 420. At 412 is a Set Register that may be set by Set 412*s*. Set Register Outputs 412*o* are fed into PID Time Processor 420. Also going into PID Time Processor 420 are the Counter Outputs 410*o*.

In one embodiment of the present invention, as may be illustrated in FIG. 4, a Pulse adder/subtractor is added in front of a counter. Based on the error amount calculated during the set time by looking at the current time and the set value, the pulse adder/subtractor adds or subtracts a pulse periodically. Calculation is done by a Proportional Integral Derivative (PID) control time processor. Pulse adding/subtracting rate and the set values are kept in registers. More corrections done by setting this RTC generally indicates a higher accuracy achieved. Further accuracy may be achieved by controlling the oscillator itself (e.g. via 421 in FIG. 4).

In one embodiment of the invention a pulse adder/subtractor such as 408 in FIG. 4 may be implemented in logic to allow 3 modes of operation: 1) the next pulse to pass unchanged, 2) remove the next pulse, and 3) double the next pulse. So, for example, if the input to a pulse adder/subtractor is a 1 pps signal, then in one mode, the 1 pps signal is allowed to pass through unchanged to a counter chain (same as add or subtract zero). In another mode, the 1 pps is blocked for say 1 second so that no pulse is allowed though. This would subtract a single pulse. In another mode, the 1 pps signal may be doubled (via for example XOR circuitry) yielding a 2 pps signal to the counter. This would add a pulse.

For simplicity of illustration, Applicant will take a very simplistic example and demonstrate how an embodiment of the invention might work.

First assume for sake of illustration that the output of a frontend counter is exactly 1.0 pps when it should be 1.0 pps. That is, in an actual time frame of, for example, 10 seconds the output of the frontend is 10 pulses. We know that for the RTC to keep correct time assuming that its input is specified at 1.0 pps that for every 10 pulses the Frontend outputs, we do not need to add or subtract any pulses and can let the pulses into the RTC (e.g. the second, minute, hour, day, month, and year counter chain).

Assume next, for sake of illustration that the output of a frontend counter is exactly 1.1 pps when it should be 1.0 pps. That is, in an actual time frame of 10 seconds the output of the frontend is 11 pulses. We then know that for the RTC to keep correct time assuming that its input is specified at 1.0 pps that for every 11 pulses the Frontend outputs, we need to subtract one before letting the pulses into the RTC (e.g. the second, minute, hour, day, month, and year counter chain). In that way exactly 10 pulses will be let in for 10 seconds of actual time and the RTC will be accurate.

Assume next, for sake of illustration that the output of a frontend counter is exactly 0.9 pps when it should be 1.0 pps. That is, in an actual time frame of 10 seconds the output of the frontend is 9 pulses. We then know that for the RTC to keep correct time assuming that its input is specified at 1.0 pps that for every 9 pulses the Frontend outputs, we need to add one before letting the pulses into the RTC (e.g. the second, minute, hour, day, month, and year counter chain). In that way exactly 10 pulses will be let in for 10 seconds of actual time and the RTC will be accurate.

The above example would operate by adjusting the pps rate.

FIG. 4 for example, illustrates how the Pulse adder/subtractor 408 may operate on the output 405 of the Oscillator 404. In this embodiment the Counter Outputs 410*o* and Set Register Outputs 412*o* are input to the PID Time Processor 420 which may then adjust the Oscillator 404, control the Pulse adder/subtractor 408, and/or the Frontend, Second, Minute, Hour, Day, Month, Year counters 410. The following combinations of control/adjustment may be made: none (i.e. not 404 and not 408 and not 410), 404 only, 408 only, 410 only, 404 and 408, 404 and 410, 408 and 410, 404 and 408 and 410. Applicant(s) hereby submit that the foregoing combinations comply with applicable EP (European Patent) standards. No preference is given any combination.

For example, a simplistic illustration of how FIG. 4 might work is the following. Assume that the XTAL is nominally at 32768 Hz ("OSCfreq") and that block 410 outputs from the second counter a pulse every OSCfreq/32768, (e.g. every 32768 pulses counted from the Oscillator result in 1 pulse from the Second counter in 410). Assume that in reality the OSCfreq is 32769 Hz. Now the second counter output is not 1 pps but is slightly faster in time (32769/32768 pps). So we are "accumulating" 1/32768 error for each pulse output from the second counter. So after 32768 seconds (approx 9 hours) we will be off by 1 second (i.e. 32768 counts). Now the Counter Outputs 410 all go the PID Time Processor 420 and assuming that the Set input 412*s* has loaded the Set Register 412 with the correct time which also goes via Set Register Outputs 412*o* to the PID Time Processor 420. The PID Time Processor 420 could calculate the differences and determine that to correct the time it will subtract a single pulse from the Oscillator via control 423 every time it receives an output from the Second counter in 410.

Figure 5:
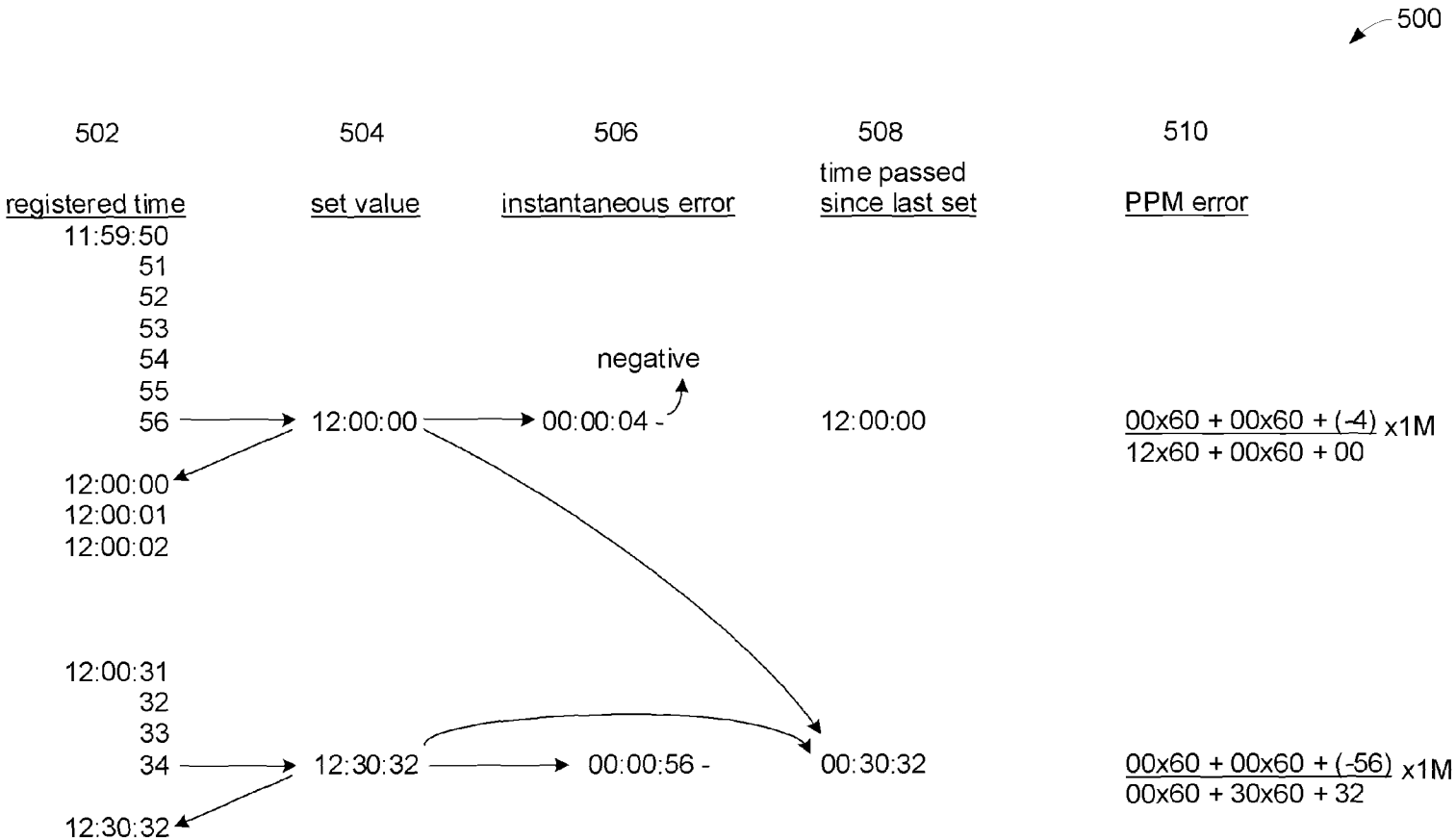
FIG. 5 illustrates one embodiment of the invention showing values, error, etc.

FIG. 5 illustrates, generally at 500, how an embodiment of the invention works. First an example of error extraction is illustrated, then a possible technique as embodied in a tangible physical device is illustrated. At 502 is the time registered/counted in the time/calendar counter, 504 illustrates set values that may come at an arbitrary time, at 506 is the instantaneous error, at 508 the time difference between two set operation, and at 510 is shown ppm error.

The set value goes to the register/counter (e.g. 412 in FIG. 4) immediately. The difference between the current counted time and the set value is divided by the time passed since the last set operation and multiplied by 1 million to find the ppm error. The first recorded "time past last set" is the set value itself because no set operation was done in the past.

In one embodiment to simplify the calculation an assumption may be made that, for example, to accept any error value longer than say 10 minutes without any calculation because such an error is most likely due to some malfunction in the time/calendar than due to clock drift of the oscillator.

One such technique for correction might be:

0—Start when CST is entered

1—CD−CCT−CST

2—if abs(CD)>360 s, skip to 5

3—CE=1000000*CD/(CST−PST)

4—TCV=KP*CE+KI1*CE+KI2*PE+KI3*PPE+KD1(CE−PE)+KD2*(PE−PPE)

5—Move PE to PPE, move CE to PE, move CST to PST

6—Move PST to counter.

Here, CD is the current difference between set time and counter value, CCT is current counter time, CST is current set time, PST is previous set time, CE current ppm error, TCV is total correction factor, KP is proportional coefficient, KI1 is first integral coefficient, KI2 is second integral coefficient, PE is pervious difference, KI3 is third integral coefficient, PPE is previous-previous difference, KD2 is first and KD2 is second derivative coefficients.

KP, KI1, KI2, KI3, KD1, KD2 in one embodiment may be 4 bit binary values and may be entered into a device via a communications means such as I2C. Their default values may be zero, therefore a default for TCV is zero. Such an approach as described above when expected to correct for +−128 ppm would result in CE, PE, and PPE being 8 bit numbers. TCV would also be an 8 bit number and it may saturate but should not roll over.

Figure 6:
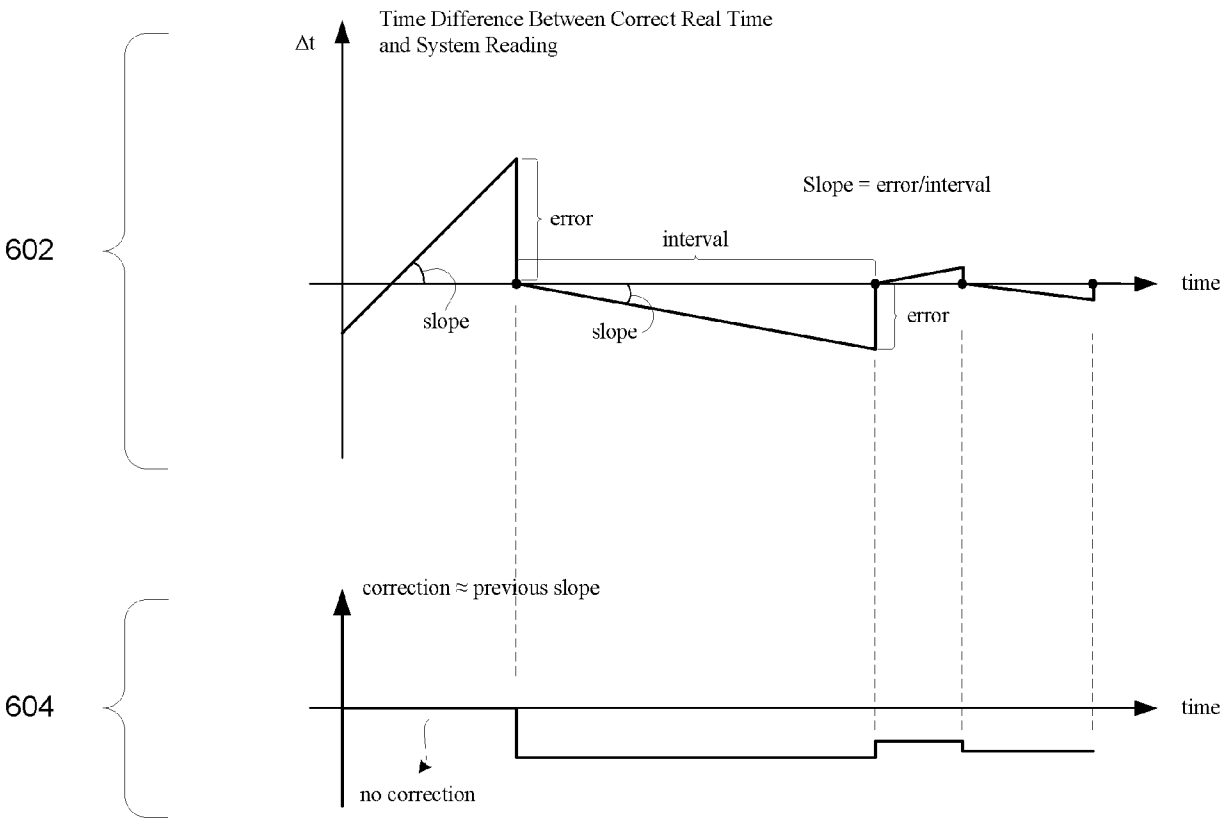
FIG. 6 illustrates how correction over time may occur for one embodiment of the invention.

FIG. 6, generally at 600, illustrates how correction over time may occur for one embodiment of the invention. At 602 is a time difference between correct real time and system reading graph. At 604 is a correction corresponding to the same system time as plotting at 602.

Figure 7:
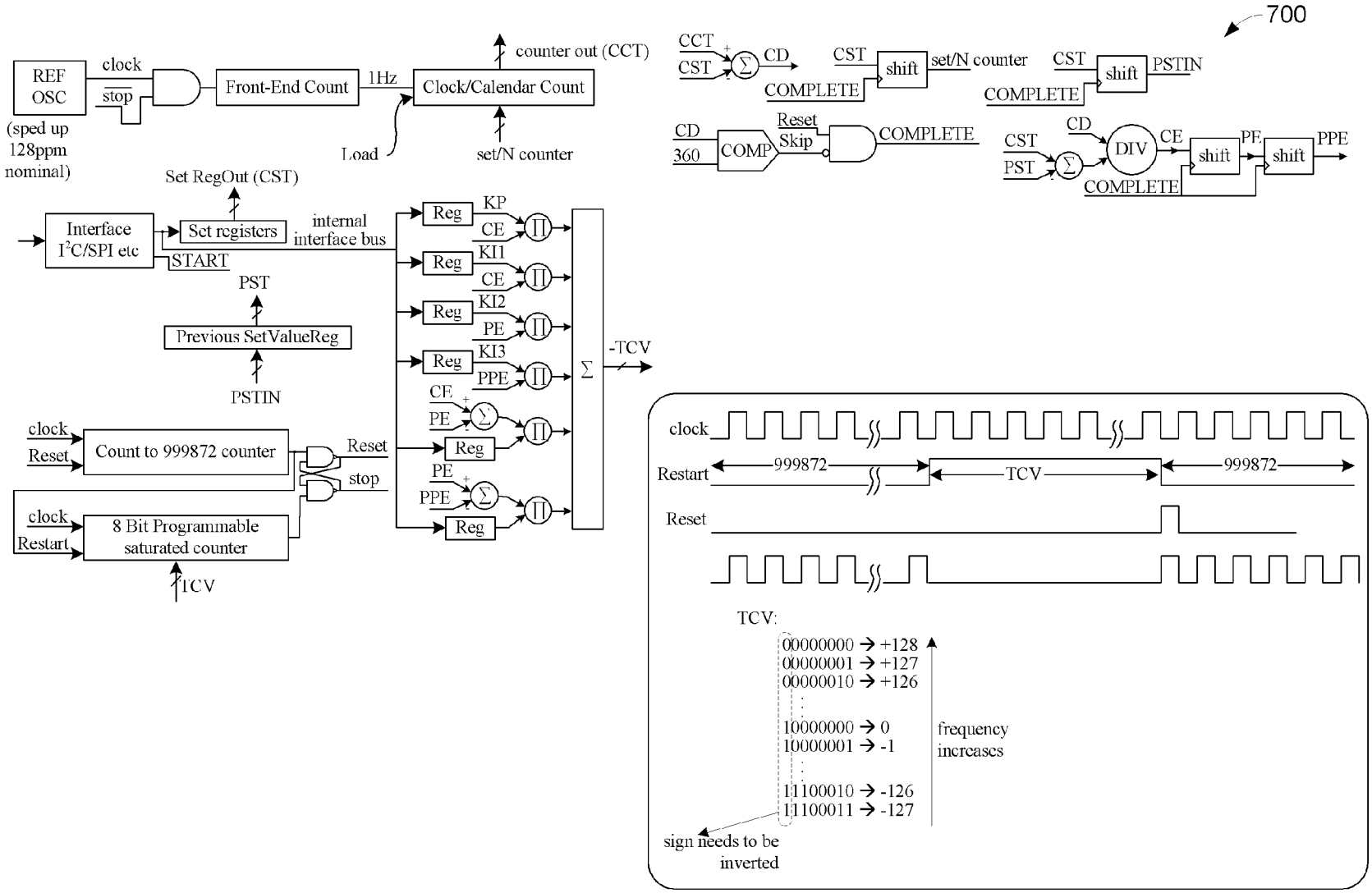
FIG. 7 illustrates one embodiment of the invention in block and schematic form.

FIG. 7, generally at 700, illustrates one embodiment of the invention in block and schematic form.

Figure 8:
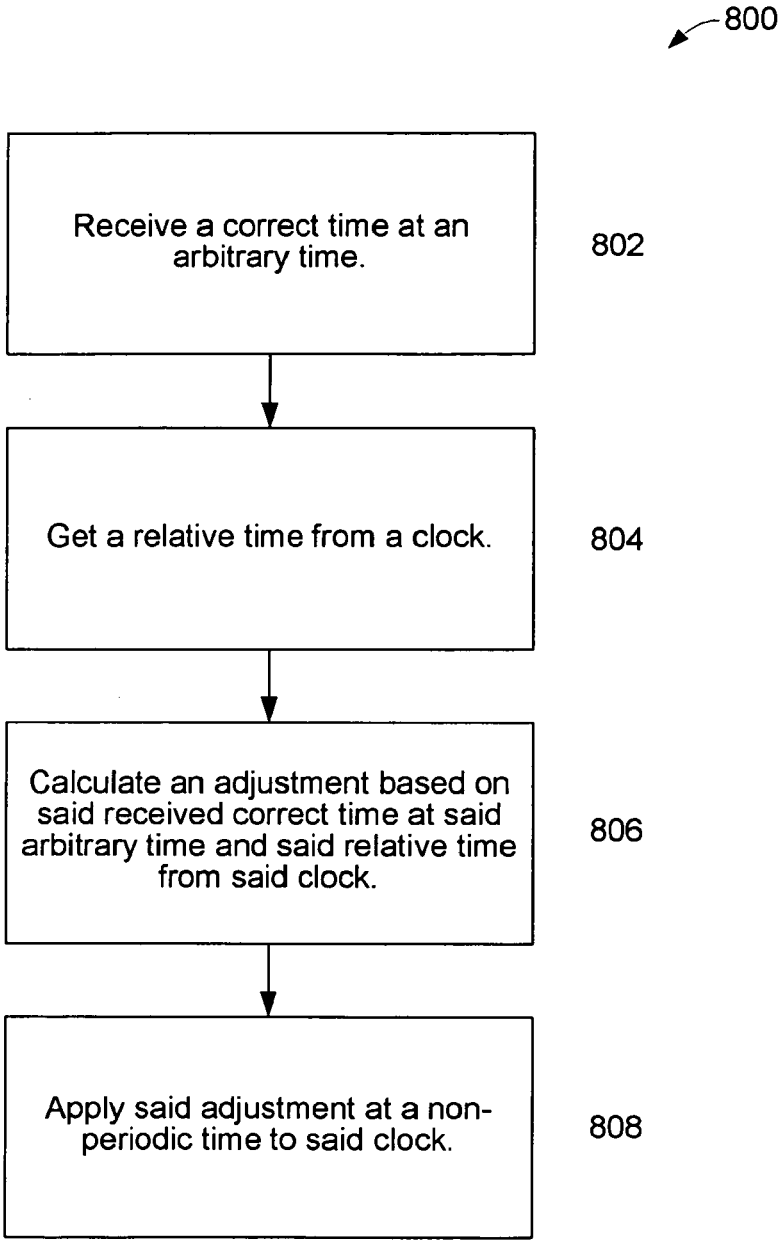
FIG. 8 illustrates one embodiment of the invention in flow chart form.

FIG. 8, generally at 800, illustrates one embodiment of the invention in flow chart form. At 802 a correct time is received at an arbitrary time (e.g. random). At 804 the relative time from a clock is retrieved. At 806 an adjustment (e.g. compensation) is calculated based on the arbitrarily received correct time and the relative time. At 808 the adjustment is applied to the clock.

Note that in various embodiments of the invention, as for example, illustrated in FIG. 8, the adjustment at 808 need not bring the clock to read the same as the correct time. That is, a PID, slope, discreet time, etc. approach may be used for the adjustment. For example, an adjustment of none, one, or minus one pulse may be applied to the input of the clock.

Figure 9:
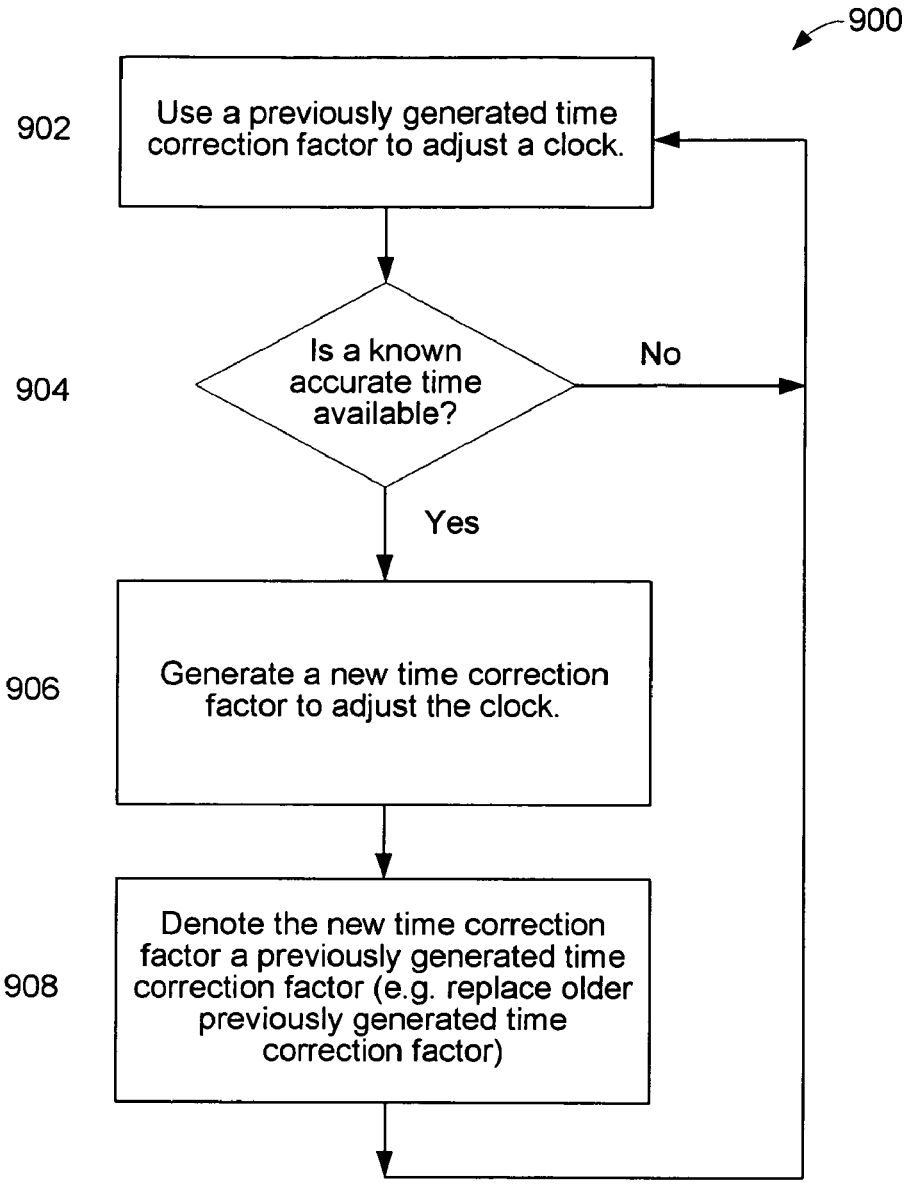
FIG. 9 illustrates one embodiment of the invention in flow chart form.

FIG. 9 illustrates, generally at 900, one embodiment of the invention. At 902 a previously generated time correction factor is used to adjust a clock. (If this is the first time the clock is being adjusted then whatever the correction factor is may be used. Generally at manufacturing or power up time the factor may be set to some nominal value.) At 904 a determination is made to see if a known accurate time is available. If not then the previously generated time correction factor may be used. If a known accurate time is available then at 906 a new time correction factor is generated. At 908 the new correction factor replaces the older previously generated time correction factor and at 902 it is used to adjust the clock.

In FIG. 9 the determination to see if a known accurate time is available at 904 may be made at a random time interval.

Figure 10:
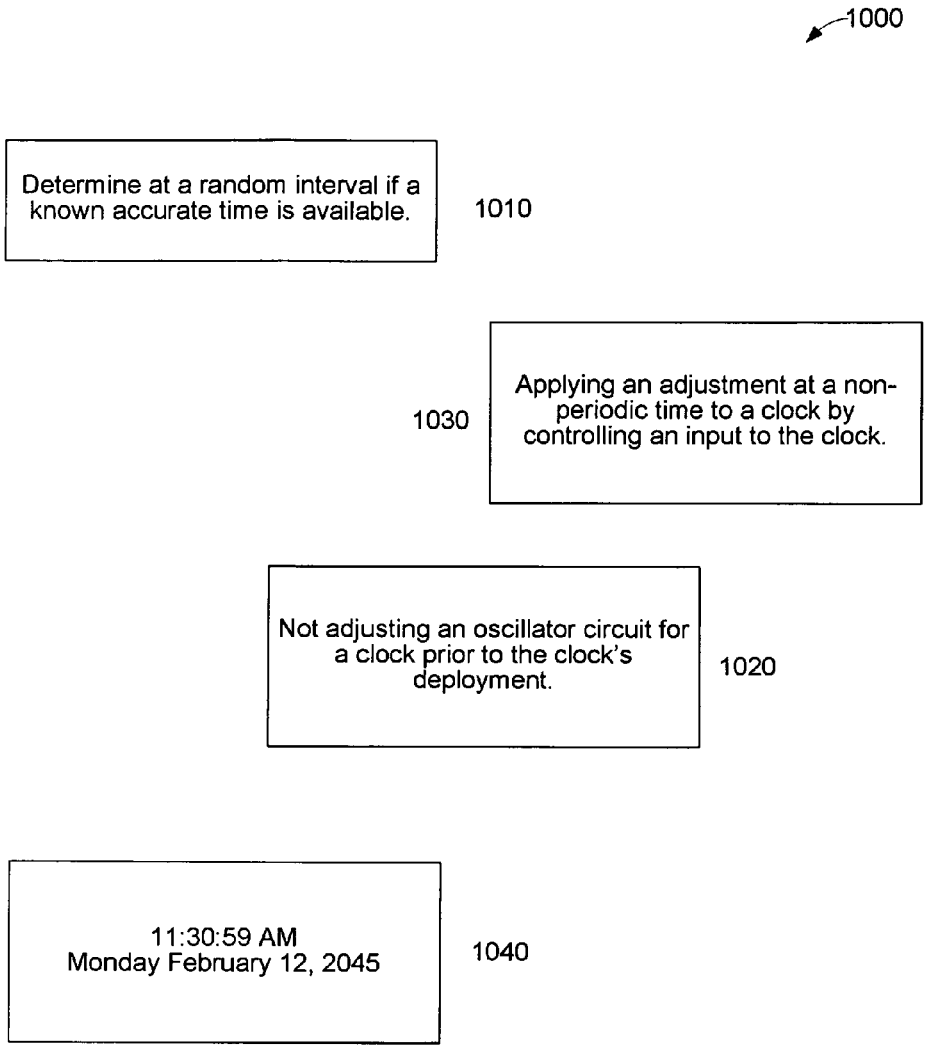
FIG. 10 illustrates various embodiments of the invention.

FIG. 10 illustrates, generally at 1000, various embodiments of the invention. At 1010 at random time intervals a determination is made if a known accurate time is available. At 1020 an oscillator circuit is not adjusted prior to a clock's deployment. At 1030 a non-periodic time adjustment is applied to a clock by controlling an input to the clock. At 1040 is shown a usable tangible result in the form of a time/date display showing 11:30:59 AM Monday Feb. 12, 2045.

One of skill in the art will appreciate that embodiments of the invention are especially useful for applications where a device containing a clock is already connected to, or may be connected to, time servers. For example personal mobile computers (that may be hooked up to a network at random times), and other devices that may be infrequently connected such as settop boxes, etc.

Real time clocks are useful for time keeping purposes and one of the most common is a clock being driven by a 32768 Hz crystal oscillator and requiring very low power. When they are supplied by a small battery, they may work for long periods of time, however, the crystal resonator has a certain accuracy and drifts. This accuracy is usually a few tens of ppms. It is possible to tune the oscillator to increase its accuracy, however each product would then need an individual tuning. Additionally, operating conditions for each product may cause crystal drift. One of skill in the art will appreciate that if the adaptive tuning as illustrated in the present invention is used that accuracy is improved and in some cases an alternative to the crystal may be used, for example, such as but not limited to, RC based oscillator, ceramic resonator, etc. can be used with reasonable accuracy.

Thus a method and apparatus for externally aided self adjusting real time clock have been described.

FIG. 1 illustrates a network environment 100 in which the techniques described may be applied. The network environment 100 has a network 102 that connects S servers 104-1 through 104-S, and C clients 108-1 through 108-C. More details are described below.

Figure 2:
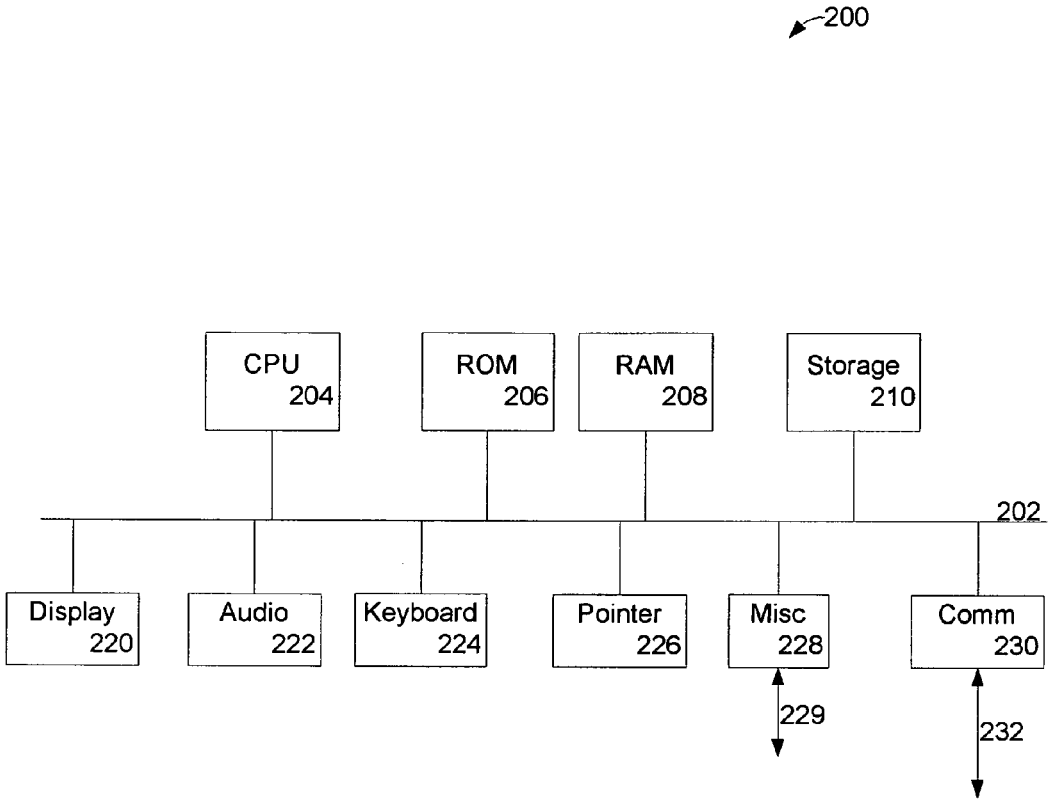
FIG. 2 is a block diagram of a computer system in which some embodiments of the invention may be used.

FIG. 2 is a block diagram of a computer system 200 in which some embodiments of the invention may be used and which may be representative of use in any of the clients and/or servers shown in FIG. 1, as well as, devices, clients, and servers in other Figures. More details are described below.

Referring back to FIG. 1, FIG. 1 illustrates a network environment 100 in which the techniques described may be applied. The network environment 100 has a network 102 that connects S servers 104-1 through 104-S, and C clients 108-1 through 108-C. As shown, several computer systems in the form of S servers 104-1 through 104-S and C clients 108-1 through 108-C are connected to each other via a network 102, which may be, for example, a corporate based network. Note that alternatively the network 102 might be or include one or more of: the Internet, a Local Area Network (LAN), Wide Area Network (WAN), satellite link, fiber network, cable network, or a combination of these and/or others. The servers may represent, for example, disk storage systems alone or storage and computing resources. Likewise, the clients may have computing, storage, and viewing capabilities. The method and apparatus described herein may be applied to essentially any type of visual communicating means or device whether local or remote, such as a LAN, a WAN, a system bus, etc. Thus, the invention may find application at both the S servers 104-1 through 104-S, and C clients 108-1 through 108-C.

Referring back to FIG. 2, FIG. 2 illustrates a computer system 200 in block diagram form, which may be representative of any of the clients and/or servers shown in FIG. 1. The block diagram is a high level conceptual representation and may be implemented in a variety of ways and by various architectures. Bus system 202 interconnects a Central Processing Unit (CPU) 204, Read Only Memory (ROM) 206, Random Access Memory (RAM) 208, storage 210, display 220, audio, 222, keyboard 224, pointer 226, miscellaneous input/output (I/O) devices 228, and communications 230. The bus system 202 may be for example, one or more of such buses as a system bus, Peripheral Component Interconnect (PCI), Advanced Graphics Port (AGP), Small Computer System Interface (SCSI), Institute of Electrical and Electronics Engineers (IEEE) standard number 1394 (FireWire), Universal Serial Bus (USB), etc. The CPU 204 may be a single, multiple, or even a distributed computing resource. Storage 210, may be Compact Disc (CD), Digital Versatile Disk (DVD), hard disks (HD), optical disks, tape, flash, memory sticks, video recorders, etc. Display 220 might be, for example, an embodiment of the present invention. Note that depending upon the actual implementation of a computer system, the computer system may include some, all, more, or a rearrangement of components in the block diagram. For example, a thin client might consist of a wireless hand held device that lacks, for example, a traditional keyboard. Thus, many variations on the system of FIG. 2 are possible.

For purposes of discussing and understanding the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk-read only memories (CD-ROMs), and magnetic-optical disks, read-only memories (ROMs), random access memories (RAMs), electrically programmable read-only memories (EPROM)s, electrically erasable programmable read-only memories (EEPROMs), FLASH memories, magnetic or optical cards, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, set top boxes, network PCs, minicomputers, mainframe computers, and the like. The invention can also be practiced in distributed computing environments where tasks are performed by remote processing devices that are linked through a communications network.

The methods of the invention may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, or mathematical expression. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

A machine-readable medium is understood to include any mechanism for storing or transmitting information in a form readable by a machine (e.g., a computer). For example, a machine-readable medium includes read only memory (ROM); random access memory (RAM); magnetic disk storage media; optical storage media; flash memory devices; electrical, optical, acoustical or other form of propagated signals which upon reception causes movement in matter (e.g. electrons, atoms, etc.) (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

As used in this description, "substantially" or "substantially equal" or similar phrases are used to indicate that the items are very very close or similar. Since two physical entities can never be exactly equal, a phrase such as "substantially equal" is used to indicate that they are for all practical purposes equal.

It is to be understood that in any one or more embodiments of the invention where alternative approaches or techniques are discussed that any and all such combinations as my be possible are hereby disclosed. For example, if there are five techniques discussed that are all possible, then denoting each technique as follows: A, B, C, D, E, each technique may be either present or not present with every other technique, thus yielding 2^5 or 32 combinations, in binary order ranging from not A and not B and not C and not D and not E to A and B and C and D and E. Applicant(s) hereby claims all such possible combinations. Applicant(s) hereby submit that the foregoing combinations comply with applicable EP (European Patent) standards. No preference is given any combination.

Thus a method and apparatus for externally aided self adjusting real time clock have been described.

What is claimed is:

1. An apparatus comprising:

a circuit having a pulse train output;

an adjusting circuit having an input, a control input, and an output, said adjusting circuit input coupled to said pulse train output;

a real-time clock having an input, a plurality of set inputs, and a plurality of counter outputs, said real-time clock input coupled to said adjusting circuit output, and said plurality of counter outputs producing a usable tangible result for a user; and a proportional integral derivative time processor having a first output and a second output, said first output operatively coupled to said adjusting circuit control input, and said second output operatively coupled to said plurality of set inputs.

2. The apparatus of claim 1 wherein said adjusting circuit control input can leave said pulse train unaltered.

3. The apparatus of claim 2 wherein said adjusting circuit control input can remove one or more pulses from said pulse train.

4. The apparatus of claim 3 wherein said adjusting circuit control input can add one or more pulses to said pulse train.

5. The apparatus of claim 4 wherein said pulse train output is a 32768 Hz pulse train output.

* * * * *